United States Patent [19]

Gibbs

[11] 4,437,549

[45] Mar. 20, 1984

[54] SUITCASE

[76] Inventor: Richard B. Gibbs, 11548 Thurston Cir., Los Angeles, Calif. 90049

[21] Appl. No.: 128,635

[22] Filed: Mar. 10, 1980

[51] Int. Cl.[3] ..... A45C 7/00

[52] U.S. Cl. ..... 190/109; 190/126

[58] Field of Search ..... 190/52, 51; 150/28 R, 150/52 R

[56] References Cited

U.S. PATENT DOCUMENTS

| | | | |
|---|---|---|---|
| 775,343 | 11/1904 | Anderson | 190/52 |
| 1,460,016 | 6/1923 | Emery | 190/52 |
| 2,025,101 | 12/1935 | Halpin | 190/52 |
| 2,282,408 | 5/1942 | Lowe | 190/51 |
| 2,334,079 | 11/1943 | Feinberg | 190/52 |
| 2,738,041 | 3/1956 | Haes | 190/51 |
| 3,306,404 | 2/1967 | Yellin | 190/51 |
| 4,106,598 | 8/1978 | Davis | 190/52 |

FOREIGN PATENT DOCUMENTS

| | | | |
|---|---|---|---|
| 549524 | 12/1957 | Canada | 190/51 |

*Primary Examiner*—Herbert F. Ross

*Attorney, Agent, or Firm*—Ralph B. Pastoriza

[57] ABSTRACT

A multiple compartment suitcase defining an interior region has parallel rectangular panels, an interior side wall defined by coextensive spaced apart sides normal to the panels, a rectangular base parallel to a rectangular top and normal to the base. Intermediate the panels, a pad dividing the interior space into two compartments and a pad encompassing skirt is joined to the interior side walls. The skirt has a width greater than the normal distance from the pad extremities to the side wall. The pad is movable from a first position providing approximately similar volume compartments, to a second position in which the pad is substantially flush with the one of the panels to enable nesting of similar, yet smaller suitcases therein.

1 Claim, 4 Drawing Figures

SUITCASE

BACKGROUND OF THE INVENTION

1. Field of the Invention

This invention relates to luggage. More particularly, the invention relates to personal travel valises or suitcases having multiple compartments.

2. Description of the Prior Art

Multiple compartment suitcases heretofore available typically have zippered flaps or panels to provide access to the suitcase interior. A somewhat rigid, partly flexible panel generally divides the interior space of the suitcase into two portions, each defining a separate compartment, the volume of each being defined by the positioning of the divider.

Oftentimes, luggage is sold in matching ensembles or collections. Shipping or storing the suitcases, when empty, consumes substantial space. Both shipping and storage costs are expensive for the manufacturer and distributor. In addition, it is also desirable for the consumer to be able to compactly store luggage cases when not in use.

SUMMARY OF THE INVENTION

In accordance with this invention, a suitcase comprises a pair of parallel, planar spaced-apart panel portions, and means circumscribing the parallel, spaced-apart panel portions to define an enclosure. Pad means disposed between and parallel to the panel portions separate the enclosure to define first and second compartments. The pad means is coupled to the means circumscribing the panels such that the pad means is movable from a first position in which the first compartment has its minimum volume and the second compartment has its maximum volume, to a second position in which the first compartment has its maximum volume and the second compartment has its minimum volume.

In a more specific example, the spaced-apart panel portions are generally rectangular and the pad means comprises a generally rectangular, flexible yet firm pad and a skirt of material encircling the pad and coupling the pad to the means circumscribing the panel portions. The material has a sufficient width to allow movement of the pad normal to the panel portions within the confines of the circumscribing means.

Additional features in accordance with this invention include a positioning of the pad means sufficiently adjacent one of the panel poritons so that a maximum position for one of the panel portions does not exceed significantly more than one-half of the compartment volume and in a minimum position, substantially rests adjacent one of the panel portions to allow the nesting of a slightly smaller suitcase therein.

BRIEF DESCRIPTION OF THE DRAWINGS

The nature of the invention described herein may be best understood and appreciated by the following description taken in connection with the accompanying drawings in which.

DETAILED DESCRIPTION

Figure 1:
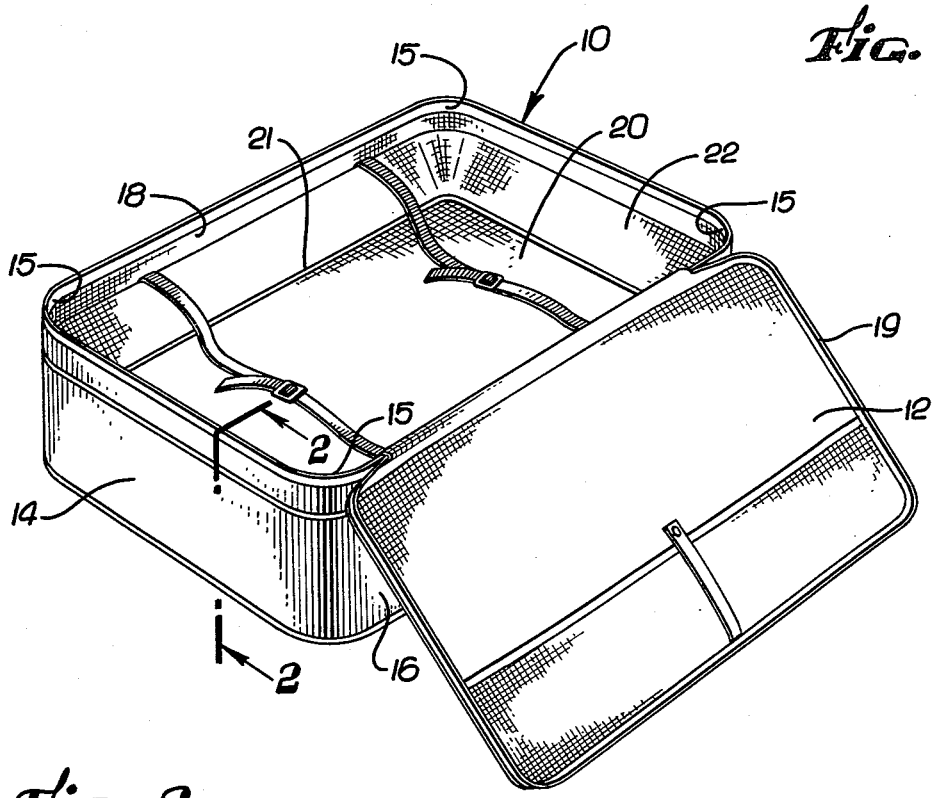
FIG. 1 is a perspective view of an example of this invention having one panel open and in which the pad is extended to a first position.
Figure 2:
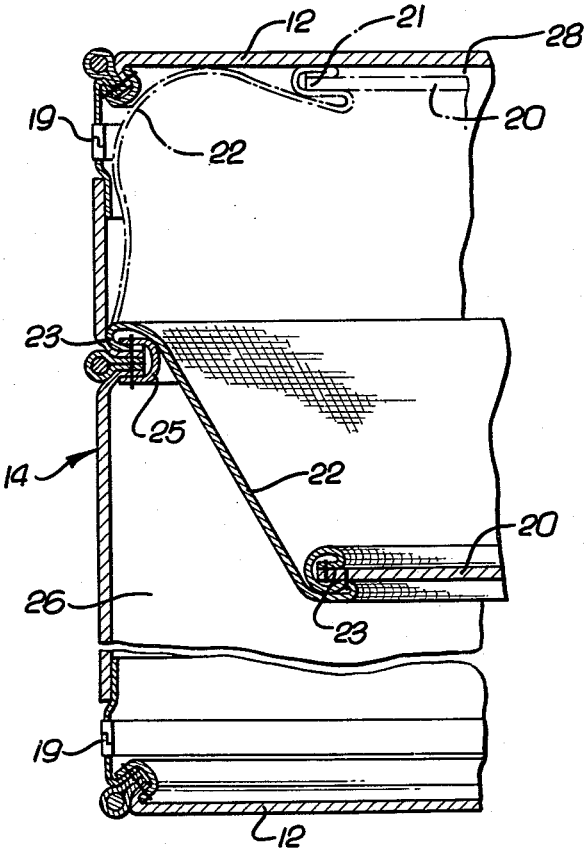
FIG. 2 is an enlarged detail cross-sectional elevational view taken along the lines 2—2 of FIG. 1 further showing the pad in a second position in phantom.
Figure 3:
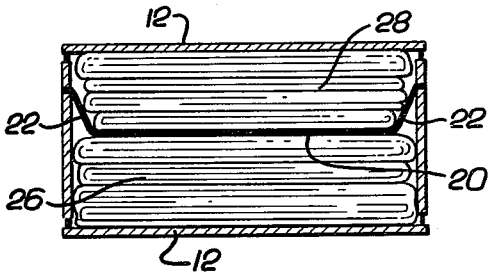
FIG. 3 is a diagrammatic cross-sectional elevational view of the invention depicted in FIG. 1 in which the pad is in a first position.
Figure 4:
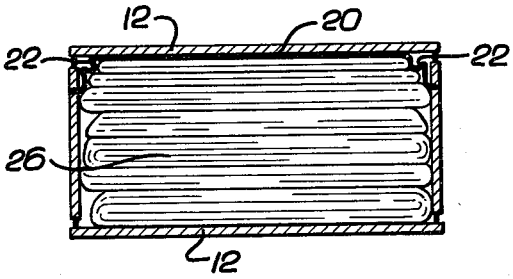
FIG. 4 is a diagrammatic cross-sectional elevational view as in FIG. 3, in which the pad is in a second position.

With particular reference to FIGS. 1, 2, 3 and 4, an example of a suitcase in accordance with this invention generally comprises an enclosure 10 defining an interior region, having a pair of opposing spaced-apart parallel panel portions 12, in this example being of generally rectangular configuration. The panel portions 12 are preferably zippered flaps of vinyl or textile materials, for example, but may be hinged zippered or locking buckle doors of leather having normally extending edges, as are found on the typical single compartment suitcases.

A pair of spaced-apart narrow side portions 14, a base portion 16 normal to and joining the side portions 14 defining juncture regions 15, and a top portion 18 joining the side portions 14 and in parallel spaced-apart relationship to the base portion 16 defining additional juncture regions 15 circumscribe the panel portions 12. Zippers 19 join the panel portions 12 to the enclosure 10, yet provide rapid and convenient access to the interior region of the enclosure 10.

A generally rectangular pad 20, quite flexible yet somewhat firm, is disposed intermediate the panel portions 12, and define a border 21. The pad 20 is of textile sandwiched polyurethane, but may be of a variety of materials. The pad requires sufficient strength to support belongings within the suitcase and durability for extended use, but flexible to allow some deformation of its normally planar shape from bulky and odd sized belongings when placed in the suitcase.

A textile skirt 22 having an interior border 23 circumscribes the pad 20 and is joined thereto. The textile skirt 22 is a narrow piece of fabric material, yet having a sufficient width to allow movement of the pad 20 within the enclosure 10. The skirt 22 has an exterior border 23 and is joined at the exterior border 23 remote from the pad 20 to the side portions 14, the base portion 16 and the top portion 18 on the interior side wall of the enclosure 10. A protective strip 25 of tough flexible material extends about the border 23 fastening the skirt to the interior wall. The textile skirt 22 is generally stitched to the pad so that the pad floats substantially centrally within the enclosure. The pad 20 has an area somewhat smaller than that of the panel portions 12 to allow the pad 20 to float easily within the enclosure 10. The skirt 22 is preferably of a material that is flexible and has a strength sufficient to withstand tearing and to support the tension on the skirt 22 from belongings when placed in the suitcase. In the particular example shown, the width of the textile skirt is sufficient to allow the pad 20 to move substantially flush with one of the panel portions 12. This provides a minimum volume in the second compartment 28 as best shown in phantom in FIG. 2 and in FIG. 4, while providing a maximum volume in the first compartment 26. The minimum volume allows substantial belongings to be packed on one side, for example, and small toiletry articles to be packed on the other side, for example. But in addition, a sufficiently large volume is provided in the first compartment 26 to enable a slightly smaller suitcase of the same type to be nested in the first suitcase. Thus, the manufacturer and distributor, when shipping or storing ensembles of suitcases, is able to nest smaller suitcases inside larger suitcases, and similarly, the consumer is able to store ensembles of such suitcases in a nested fashion.

In using a suitcase in accordance with this invention, one or both of the facing planar panel portions 12 is unzipped to enable various items to be placed in the suitcase or removed from the suitcase. If it is desired to have both compartments 26, 28 filled with clothing and belongings approximately equally, the appropriate panel portion 12 is opened exposing the second compartment 28, and allowing belongings to be placed therein. When that side is filled, the enclosure 10 is turned over, and the opposing panel portion 12 is opened exposing the first compartment 26 at which time additional belongings may be placed in the first compartment. To the extent needed, the pad 20 seeks its position generally according to the contents of the second compartment 28 and invading a portion of the erstwhile first compartment 26. If it were instead desirable to have a maximum single compartment, the panel portion 12 exposing the second compartment 28 would be opened and belongings placed therein.

Again, after the suitcase is emptied, a smaller, similar suitcase may be placed in the second compartment when the pad is moved to a minimum second compartment position. Thus, applicant has provided by way of this invention a multiple compartment suitcase, yet which allows nesting both for shipment and storage by the manufacturer and distributor and for storage and transportation by the consumer, yet allows the relative compartment sizes to be adjusted as needed by the user of the suitcase.

While the invention has been particularly shown and described with reference to a preferred example, it will be understood by those skilled in the art that various changes in form or details may be made without departing from the spirit and scope of the invention.

What is claimed is:

1. A suitcase for supporting and carrying personal belongings comprising:

(a) coextensive spaced-apart first and second panel means;

(b) means circumscribing said first and second panel means to define an interior region;

(c) a generally firm pad means disposed within said interior region between the spaced-apart first and second panel means;

(d) a textile non-elastic skirt having an interior border joined to the border of the pad means and an exterior border fastened to the interior wall of said means circumscribing the panel means at a location closer to said first panel means than to said second panel means, said pad means and skirt dividing said interior region into first and second compartments, said skirt having a width between its interior and exterior borders greater than the normal distance from the border of said pad means to said interior wall such that when said first panel means is uppermost, said pad means is suspended by said skirt in a first position approximately midway between said first and second panel means so that said first and second compartments have comparable volumes, said pad means being movable upwardly from said first position to a second position against said first panel means to be substantially flush therewith thus providing said second compartment with almost the entire volume of both compartments; and (e) means for providing access to each compartment, whereby when said pad means is in said first position, clothing and articles can be packed in said first compartment and held by said pad means and skirt in the upper half of said interior region whether or not said second compartment is empty or full, and whereby when said pad means is in said second position, identical although smaller suitcases can be received in said second compartment in nesting relationship.

* * * * *